US010237639B2

(12) United States Patent
McIntosh et al.

(10) Patent No.: US 10,237,639 B2
(45) **Date of Patent: *Mar. 19, 2019**

(54) MOTION DETECTION FOR MICROPHONE GATING

(71) Applicant: Sound Devices, LLC, Reedsburg, WI (US)

(72) Inventors: Jason McIntosh, Sugar Hill, GA (US); Matt Anderson, Baraboo, WI (US); Steve Popovich, Little Chute, WI (US)

(73) Assignee: Sound Devices, LLC, Reedsburg, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/790,915

(22) Filed: Oct. 23, 2017

(65) Prior Publication Data

US 2018/0167708 A1 Jun. 14, 2018

Related U.S. Application Data

(63) Continuation of application No. 14/952,501, filed on Nov. 25, 2015, now Pat. No. 9,800,964.

(60) Provisional application No. 62/097,254, filed on Dec. 29, 2014.

(51) Int. Cl.
*H04R 1/04* (2006.01)
*H04R 29/00* (2006.01)

(52) U.S. Cl.
CPC ..... *H04R 1/04* (2013.01); *H04R 29/004* (2013.01); *H04R 2430/01* (2013.01)

(58) Field of Classification Search
CPC ..... H04R 1/04; H04R 29/004; H04R 2430/01
USPC ..... 381/56, 111–115, 122, 123
See application file for complete search history.

(56) References Cited

U.S. PATENT DOCUMENTS

| | | | |
|---|---|---|---|
| 4,213,197 | A | 7/1980 | Magori |
| 8,401,202 | B2 | 3/2013 | Brooking |
| 8,712,069 | B1 | 4/2014 | Murgia et al. |
| 8,724,829 | B2 | 5/2014 | Visser et al. |
| 2004/0096072 | A1 | 5/2004 | Orten |
| 2007/0237344 | A1 | 10/2007 | Oster et al. |
| 2011/0135118 | A1 | 6/2011 | Osborne |
| 2013/0010984 | A1 | 1/2013 | Hejnicki |
| 2013/0077442 | A1 | 3/2013 | Hersey |
| 2013/0094668 | A1 | 4/2013 | Poulsen et al. |
| 2013/0129102 | A1 | 5/2013 | Li et al. |
| 2016/0097855 | A1 | 4/2016 | Qutub et al. |

OTHER PUBLICATIONS

Non-Final Office Action on U.S. Appl. No. 14/952,501 dated Jan. 12, 2017.
Notice of Allowance on U.S. Appl. No. 14/952,501 dated Jun. 20, 2017.

*Primary Examiner* — David Ton
(74) *Attorney, Agent, or Firm* — Foley & Lardner LLP

(57) ABSTRACT

A system and method for performing microphone gating operations, is disclosed. The system and method include a transmitter configured to emit a transmit signal towards an object and a receiver configured to receive a reflected signal from the object, the reflected signal corresponding to the transmit signal. The system and method also include a controller configured to instruct the transmitter to emit the transmit signal and receive the reflected signal from the receiver. The controller is further configured to detect motion of the object based upon the reflected signal and turn a microphone on or off based upon the motion of the object.

24 Claims, 4 Drawing Sheets

MOTION DETECTION FOR MICROPHONE GATING

CROSS-REFERENCE TO RELATED PATENT APPLICATIONS

This application is a continuation of U.S. application Ser. No. 14/952,501, filed Nov. 25, 2015, which claims priority to U.S. Provisional Patent Application No. 62/097,254, filed on Dec. 29, 2014, the entireties of which are incorporated by reference herein.

BACKGROUND

Microphones are commonly used in a wide variety of applications, such as, concerts, choirs, various types of public address or broadcast systems, recording studios, headsets, radios, telephones, and the like. Generally speaking, a microphone is a device that converts acoustic energy or sound waves into electric or audio signals, which may then be amplified, transmitted, and recorded as desired. A typical microphone may include a housing encapsulating therein a transducer or a sensor for sensing the sound waves. The sound waves may cause a diaphragm within the housing of the microphone to vibrate. These vibrations of the diaphragm may be converted into the electric or audio signals, which may be further manipulated (e.g., amplified, filtered, mixed) or recorded. In many applications, several microphones may be used simultaneously.

SUMMARY

In accordance with at least some aspects of the present disclosure, a method may include transmitting at least one transmit signal using a transmitter towards an object and recording at least one reflected signal reflected from the object using a receiver, the at least one reflected signal corresponding to the at least one transmit signal. The method may also include detecting, by a controller, motion of the object based upon the at least one reflected signal and performing a microphone gating operation on a microphone, by the controller, based upon the detected motion of the object.

In accordance with at least some other aspects of the present disclosure, a system may include a transmitter configured to emit a transmit signal towards an object and a receiver configured to receive a reflected signal from the object, the reflected signal corresponding to the transmit signal. The system may also include a controller configured to instruct the transmitter to emit the transmit signal and receive the reflected signal from the receiver, the controller further configured to detect motion of the object based upon the reflected signal and turn a microphone on or off based upon the motion of the object.

In accordance with yet other aspects of the present disclosure, another method may include transmitting at least one transmit signal using a transmitter towards an object and recording at least one reflected signal reflected from the object using a receiver, the at least one reflected signal corresponding to the at least one transmit signal. The method may further include detecting, by a controller, motion of the object based upon the at least one reflected signal and calculating, by the controller, a distance, D, from the receiver to the object if the motion of the object is detected. The method may also include determining, by the controller, if the distance, D, is within a range of interest, turning a microphone on, by the controller, if the distance, D, is within the range of interest, and turning the microphone off, by the controller, if the distance, D, is not within the range of interest.

The foregoing is a summary of the disclosure and thus by necessity contains simplifications, generalizations and omissions of detail. Consequently, those skilled in the art will appreciate that the summary is illustrative only and is not intended to be in any way limiting. Other aspects, inventive features, and advantages of the devices and/or processes described herein, as defined by the claims, will become apparent in the detailed description set forth herein and taken in conjunction with the accompanying drawings.

DETAILED DESCRIPTION

The present disclosure relates to turning a microphone on or off depending on whether a user of the microphone is within a range of interest of the microphone. Specifically, the present disclosure relates to turning the microphone on when the user is within the range of interest and turning the microphone off when the user moves out of the range of interest. By virtue of turning the microphone on only when the user is within the range of interest, any background or undesired noise is reduced. To determine whether the user is within the range of interest or not, a controller associated at least indirectly with the microphone may continuously keep track of motion of the user, even when the user is away from the microphone. In order to detect such motion of the user at a distance, the present disclosure uses a transmitter to emit a transmit signal towards the user, and a receiver for receiving the reflected signal bounced off of the user. The controller may then utilize the reflected signal to detect motion, as further described below.

Figure 1:
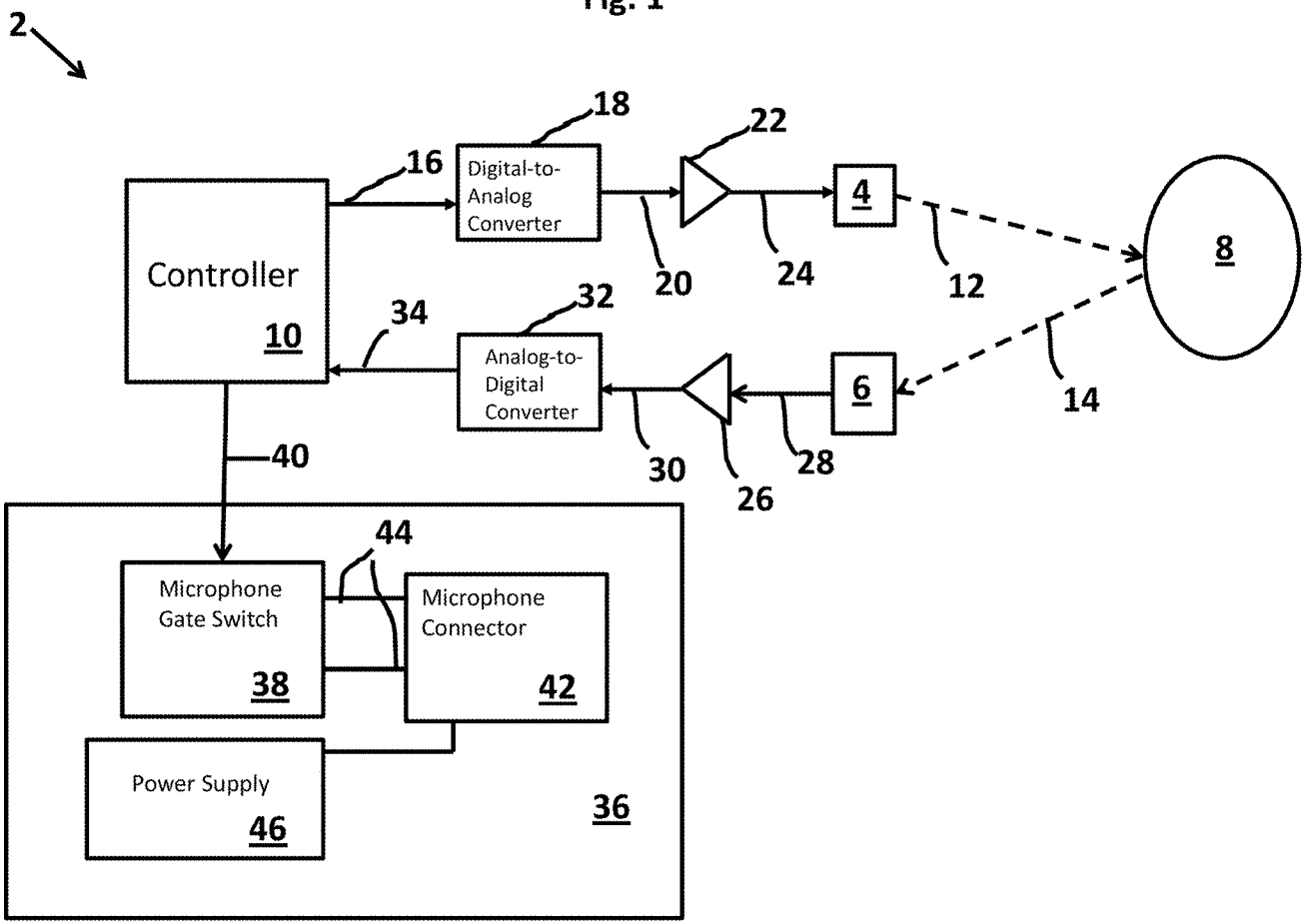
FIG. 1 is a simplified block diagram of a microphone gating system, in accordance with at least some embodiments of the present disclosure.

Referring to FIG. 1, an illustrative block diagram of a microphone gating system 2 is shown, in accordance with at least some embodiments of the present disclosure. As shown, the microphone gating system 2 may include a transmitter 4 in at least indirect communication with a receiver 6 to facilitate microphone gating operations based on motion of an object 8. In at least some embodiments, the object 8 may be a human being, such as, a performer, who may move around during the course of a performance. In other embodiments, the object 8 may be an animal, instrument, or other type of living/non-living entity whose motion is of relevance in performing microphone gating operations. The transmitter 4 and the receiver 6 may be operated under control of a controller 10. For example, in at least some embodiments, the controller 10 may instruct the transmitter 4 to emit a transmit signal 12 into a spatial zone programmed within the transmitter, and receive a reflected signal 14 from a spatial zone programmed within the receiver 6. For purposes of explanation, it is assumed in the present disclosure that the object 8 is situated within the spatial zone of both the transmitter 4 and the receiver 6. Thus, the transmit signal 12 may be directed towards the object 8, while the reflected signal 14 may be a part or all of the transmit signal reflected or bounced off of the object.

To command the transmitter 4 to emit the transmit signal 12, the controller 10 may output a digital signal through a communication port 16 to a digital-to-analog converter (DAC) 18. The DAC 18 may convert the digital signal into an analog signal (also called an analog transmitter signal) and output the analog signal through a connection 20 to a transmitter amplifier circuit 22. The transmitter amplifier circuit 22 may amplify the analog signal into an amplified analog signal, which in turn may be input into the transmitter 4 through a connection 24. In at least some embodiments, the transmitter amplifier circuit 22 may utilize one or more operational amplifiers or other types of power electronics to amplify the analog signal. Upon receiving the amplified analog signal from the transmitter amplifier circuit 22, the transmitter 4 may emit the transmit signal 12 towards the object 8. The transmit signal 12 may travel through the air (or other acoustic medium), reach the object 8, and bounce or reflect off of the object as the reflected signal 14. In controlling the transmitter 4, the controller 10 may also regulate, for example, the amplitude, frequency, phase, and other variables of the transmit signal 12. In at least some embodiments, the transmit signal 12 may be an acoustic ultrasonic or ultrasound pulse or wave type signal at a frequency of about forty kilohertz (~40 kHz) with a duration of about one half of a millisecond to about one and two tenths of a millisecond (~0.5 to 1.2 milliseconds). In other embodiments, the transmit signal 12 may have a different frequency and/or duration.

Like the transmit signal 12, the reflected signal 14 (also called an analog receiver signal) may also be an acoustic ultrasonic or ultrasound pulse or wave type signal. Thus, the receiver 6 may be configured to receive signals at a frequency produced by the transmitter 4. The reflected signal 14 may be received by the receiver 6 and passed on to an receiver amplifier circuit 26 on a connection 28. The receiver amplifier circuit 26 may utilize one or more operational amplifiers or other types of power electronics to amplify the reflected signal 14 and output the amplified reflected signal through a connection 30 to an analog-to-digital (ADC) converter 32. The ADC 32 may convert the amplified reflected signal into a digital signal for use by the controller 10. In at least some embodiments, the ADC 32 may use a sample-rate of about three hundred and twenty kilohertz (~320 kHz) for the conversion. In other embodiments, the ADC 32 may use a different sample-rate. The ADC 32 may output the digital signal to the controller 10 through communication port 34. Upon the transmission of each of the transmit signals 12, at the conclusion of the transmission of the transmit signals, at a predetermined time thereafter, or at times that may be synchronized in relation to the timing of each transmitted signal, the controller 10 may begin storing digitized samples. The controller 10 may store the digitized samples to a memory or data buffer to form a digital record for each of the digital signals received from the ADC 32 and use the digital record to determine, if and how much, the object 8 has moved from a previous location. The length of the data buffer for each of the digital signals (e.g., pulse) may range from five to ten milliseconds (5-10 ms). At a sample rate of about three hundred and twenty kilo hertz (~320 kHz), the corresponding number of samples in the buffer typically range from about sixteen hundred to thirty two hundred samples (~1600-3200 samples). In other embodiments, the sample rate may have a different frequency and the length of the data buffer may have a different duration.

Based on the motion of the object 8, the controller 10 may also determine whether a microphone gating operation should be performed to turn on or turn off a microphone 36. Microphone gating may be defined as adjusting the gain or level of the microphone 36 to an on state, off state, or in other cases, to a preferred gain.

If the controller 10 determines that a microphone gating operation should be performed to turn on/off the microphone 36, the controller may actuate a microphone gate switch 38 via a communication port 40. In at least some embodiments, the microphone gate switch 38 may be a field effect transistor (FET) switch, although other types of solid state switches, as well as logic outputs from a processor, vacuum tube switches, solar cells, diodes, and other switching devices may be employed in other embodiments. The position of the microphone gate switch 38 may indicate whether the microphone 36 is to be turned on or turned off. The microphone gate switch 38 may in turn control at least indirectly a microphone connector 42 via communication port 44. The microphone connector 42 may then turn on or turn off the microphone 36 in accordance with the position of the microphone gate switch 38. The microphone connector 42, as well as other electronic components of the microphone 36 may receive power from a power supply 46. The microphone connector 42 and the power supply 46 may be any of a wide variety of microphone connectors and power supplies that are commonly employed in microphone applications.

In at least some embodiments, turning the microphone 36 on or off may mean accepting or rejecting an audio signal, while in some other embodiments, turning the microphone on or off may mean attenuating the audio signal. For example, in some embodiments, turning the microphone 36 off may refer to attenuating the audio signal by a fixed amount, such as by about twenty decibels (~20 dB). In other embodiments, turning the microphone 36 off may involve attenuating the audio signal by a different level. Similarly, turning the microphone 36 on may not always correspond to a unity gain of zero decibels (0 dB), but, in at least some embodiments, may include an additional attenuation factor depending on the number of additional microphones that may be gated on in a larger system (for example, a gain reduction of about three decibels (~3 dB) for every doubling of the total number of microphones 36 that are gated on). In at least some embodiments, the action of turning the microphone 36 on or off may be accomplished using analog electronics/hardware, while in other embodiments, this action may be performed on digitized versions of the audio signal by a digital signal processor contained in the microphone gate switch 38 or the controller 10.

With specific reference to the microphone 36, in at least some embodiments, the microphone itself may function as the receiver 6, although this need not always be the case. In other embodiments, the receiver 6 may be a separate component (such as a sensor), typically mounted on, or positioned adjacent to or in the vicinity of the microphone 36. Similarly, the transmitter 4 may be mounted on, or positioned adjacent to or in vicinity of the microphone 36. In at least some embodiments, the transmitter 4 may be remotely located. Furthermore, in some embodiments, the transmitter 4 and the receiver 6 need not be separate components as shown and described above. Rather, in such embodiments, the transmitter 4 and the receiver 6 may be coupled together into a single component, such as, a transceiver or transducer, configured to emit the transmit signal 12 to, and receive the reflected signal 14 from, the object 8. The transducer may be mounted on, or positioned adjacent to or in the vicinity of, the microphone 36. Additionally, any of a variety of the transmitter 4 and the receiver 6 that are suitable for use in microphone applications and further suitable for emitting/receiving the type (e.g., ultrasonic, ultrasound, etc.) of the transmit signal 12 and the reflected signal 14, may be used in the microphone gating system 2.

Referring still to FIG. 1, in at least some embodiments, one or more of the communication ports 16, 34, 40, and 44 may be synchronized serial ports, while the connections 20, 24, 28, and 30 may be analog signals. In alternate embodiments, other types of communication interfaces, such as, Ethernet, FireWire, Universal Serial Bus (USB), Bluetooth, parallel ports, wired, wireless, radio, optical, or other types of interfaces and connections may be used for communicating information between the various devices described above.

Alternatively, or in addition to the above, one or more of the communication ports 16, 34, 30, and 44, as well as the connections 20, 24, 28, and 30 may include, for example, wireless chipsets, antennae, wired ports, signal converters, communication protocols like public switched telephone networks (PSTN), public switched data networks (PSDN), short messaging service (SMS) networks, local-area networks (LAN), voice over IP (VoIP) networks, wide area networks (WAN), virtual private networks (VPN), campus area networks, internet, and other types of networks for facilitating communication.

With respect to the controller 10, in at least some embodiments, the controller may include a digital signal processor (DSP), such as, a general-purpose stand alone or embedded processor, or a specialized processing unit. In at least some embodiments, multiple processing units may be connected together at least indirectly and utilized in combination with one another to perform various functions of the controller 10. For example, in at least some embodiments, the controller 10 may be a Texas Instruments, Inc. TMS320C6747 DSP. In other embodiments, other types of processors may be used for the controller 10. The controller 10 may further include a variety of volatile and non-volatile memory/electronic storage, such as, random access memory (RAM), read only memory (ROM), dynamic random access memory (DRAM), programmable read only memory (PROM), erasable programmable read only memory (EPROM), electrically erasable programmable read only memory (EEPROM), flash memory, and the like. Other types of storage media, for example, compact disc (CD), digital video disc (DVD), floppy discs, Blu-ray discs, or alternate optical storage, magnetic storage, computer readable media, or other electronic storage media, may be used within or in conjunction with the controller 10. Similarly, the controller 10 may be equipped with a variety of input or output devices, such as, audio recorders, video recorders, mixers, monitors, and printers. The controller 10 may also be equipped with direct memory access (DMA) modules to drive at least the communication ports 16, 34 particularly when those ports are synchronized serial ports. Other types of storage, processing, and output devices and media, or combinations thereof, that may be commonly employed in controllers used with microphones, are contemplated and considered within the scope of the present disclosure.

Furthermore, the controller 10 may be configured to process a variety of program instructions and data, in accordance with the present disclosure. Moreover, these program instructions and data need not always be digital or composed in any high-level programming language. Rather, the program instructions may be any set of signal-producing or signal-altering circuitry or media that may be capable of preforming functions, described in the present disclosure. Furthermore, the controller 10 may be located either in the general vicinity of the microphone 36, or alternatively may be located at a remote location or a cloud for communicating with the transmitter 4, the receiver 6, and the microphone 36. Additionally, notwithstanding the fact that in the present embodiment, both the transmitter 4 and the receiver 6 are controlled by the same controller (e.g., the controller 10), in at least some embodiments, each of the transmitter and the receiver may be controlled by a separate controller(s) positioned in similar or different locations.

Also, in at least some embodiments, the controller 10 may be configured to instruct the transmitter 4 to emit the transmit signal 12 using fewer or other components than those described above. Relatedly, the controller 10 may be configured to receive the reflected signal 14 from the receiver 6 using fewer or other components than those described above. It is also to be understood that only those components that are necessary for a proper understanding of the present disclosure are shown and described herein in the microphone gating system 2. Nevertheless, several other components, devices, and systems, such as, various edge enhancement filters to improve the quality of the transmitted signal 12 and the reflected signal 14, sensors, power supply units, etc., that may be commonly employed to perform functions described herein are contemplated and considered within the scope of the present disclosure.

Figure 2:
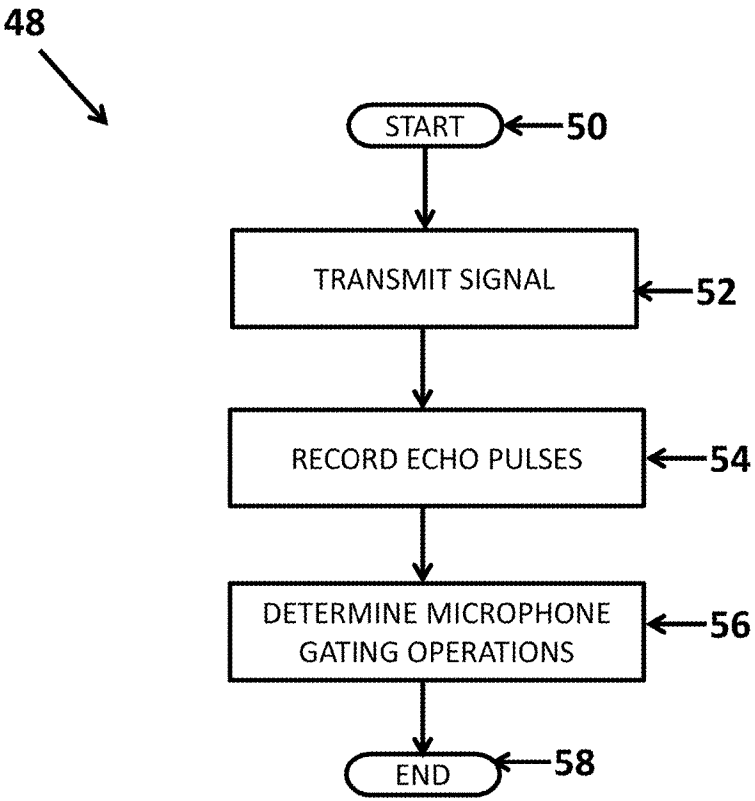
FIG. 2 is an illustrative flowchart outlining operations of the microphone gating system of FIG. 1, in accordance with at least some embodiments of the present disclosure.

Turning now to FIG. 2, a flowchart 48 outlining operations of the microphone gating system 2 is shown, in accordance with at least some embodiments of the present disclosure. As noted above, the microphone gating system 2 may be used to perform microphone gating operations to turn on or turn off the microphone 36. In general, microphone gating operations may involve continuously monitoring for motion of the object 8 within a pre-defined range of interest of the microphone 36 and turning on or keeping on the microphone if the motion of the object is within that range of interest. If the object 8 moves outside of the range of interest, the microphone 36 may be turned off. As used herein, turning on of the microphone 36 may also be termed as "gating on," while turning off of the microphone may be termed as "gating off" Advantageously, by using the microphone gating system 2, motion of the object 8 at a distance may be used to control the operation of the microphone 36. Furthermore, by virtue of using motion of the object 8 to control the microphone 36, any stationary objects, including the body of the microphone, may be easily ignored to effectively and accurately turn on or turn off the microphone.

To perform such microphone gating operations, after starting at an operation 50, the controller 10 instructs the transmitter 4 to emit the transmit signal 12 towards the object 8 at an operation 52. Each of the transmit signals 12 includes a plurality of transmit pulses. For example, in at least some embodiments, the transmit signal 12 may be emitted at the rate of about one hundred transmit pulses per second (~100 transmit pulses/sec.). Advantageously, by emitting the transmit signal 12 at such fast rates (such as ~100 transmit pulses/sec.), the motion of the object 8 may be determined with greater precision because a greater number of transmit pulses may be averaged to provide a greater reduction in false motion detection of the object. However, when transmitting at these faster rates, for any two consecutive transmit pulses within one transmit signal (e.g., the transmit signal 12), the transmission of the second transmit pulse needs to be sufficiently spaced out from the first transmit pulse to allow the first transmit pulse to decay away before recording the second transmit pulse. Without such a spacing of the transmit pulses, characteristics of the second transmit pulse may include an undesirable residual reverberation of the first transmit pulse and impact the motion detection precision of the object 8. Also, more sophisticated hardware and software equipment may be required to transmit at a faster rate. In other embodiments, the transmit signal 12 may be emitted at different or possibly slower rates, including for example, up to below ten transmit pulses per second (~10 pulses/sec.). Furthermore, in some embodiments, regardless of the transmission rate, each pulse length may include approximately one hundred sixty to three hundred and eighty four (~160-384) samples at a sampling rate of about three hundred and twenty kilo hertz (~320 kHz) and corresponding to pulse lengths of about half a millisecond to about one and two tenths of a millisecond (~0.5 to 1.2 ms). It is to be understood that the above values are illustrative and may vary in other embodiments.

The transmit signal 12 that is emitted in operation 52 may be bounced off of the object 8 as the reflected signal 14. Like the transmit signal 12, the reflected signal 14 includes a plurality of reflected pulses. The reflected signal 14 is received at an operation 54 by the receiver 6 and recorded by the controller 10. In at least some embodiments, the reflected signal 14 may be recorded by recording the acoustic pressure on the microphone 36 that is sensitive to the frequency produced by the transmitter 4. In other embodiments, other mechanisms to record signals may be employed. Furthermore, the recorded instance of the reflected signal 14 may be termed as an "echo" and the recorded instance of the reflected pulse of the reflected signal may be termed as an "echo pulse." In at least some embodiments, the controller 10 may define a series of buffers (e.g., buffer 0, buffer 1 . . . buffer N) or other type of temporary memory storage, such that each echo pulse may be stored in one of those series of buffers (or other temporary memory storage) for further processing. In some of those embodiments, buffer 0 may store the most recent echo pulses, while buffers 1-N may store older echo pulses. Thus, incoming echo pulses may be recorded in buffer 0. After every $X_1$ number of echo pulses, buffer 0 may be copied into buffer 1 and after every $X_2$ number of echo pulses, buffer 1 may be copied into buffer 2, and so on until after every $X_N$ number of echo pulses, buffer N−1 is copied into buffer N, with newer echo pulses being stored in buffer 0. Therefore, buffer N may be said to store an "old" echo pulse, while buffer 0 may be said to store the last received echo pulse. The above mentioned variables may be pre-defined within the controller 10 according to a relationship $X_m=2^m$ and N=4.

The echo pulses stored in the various buffers may be utilized to determine if any microphone gating operations should be performed in an operation 56. Specifically, the echo pulses may be used to determine, (a) whether the object 8 has moved from a previous position; (b) if the object has indeed moved, whether the motion of the object is relevant (e.g., within the range of interest); and (c) if the motion of the object is relevant, whether the gating of the microphone 36 is to be changed from a current gating configuration of the microphone. Additionally, in at least some embodiments, microphone gating operations may involve determining false positive motion. Specifically and as discussed in greater detail below, not all detected motion within the range of interest trigger a microphone gating operation. For example, background noise such as sound of a musical instrument or motion of an entity other than the object 8 within the range of interest may trigger a false positive motion. The controller 10 is configured to detect such false positive motion to accurately control microphone gating operations based only upon relevant motion of the object 8.

Each microphone gating operation ends at an operation 58 with either turning on of the microphone 36, turning off of the microphone, or keeping the previous microphone position unchanged (e.g., keeping the microphone on or off). After each microphone gating operation, the process returns to operation 50 to start a new microphone gating operation.

Figure 3:
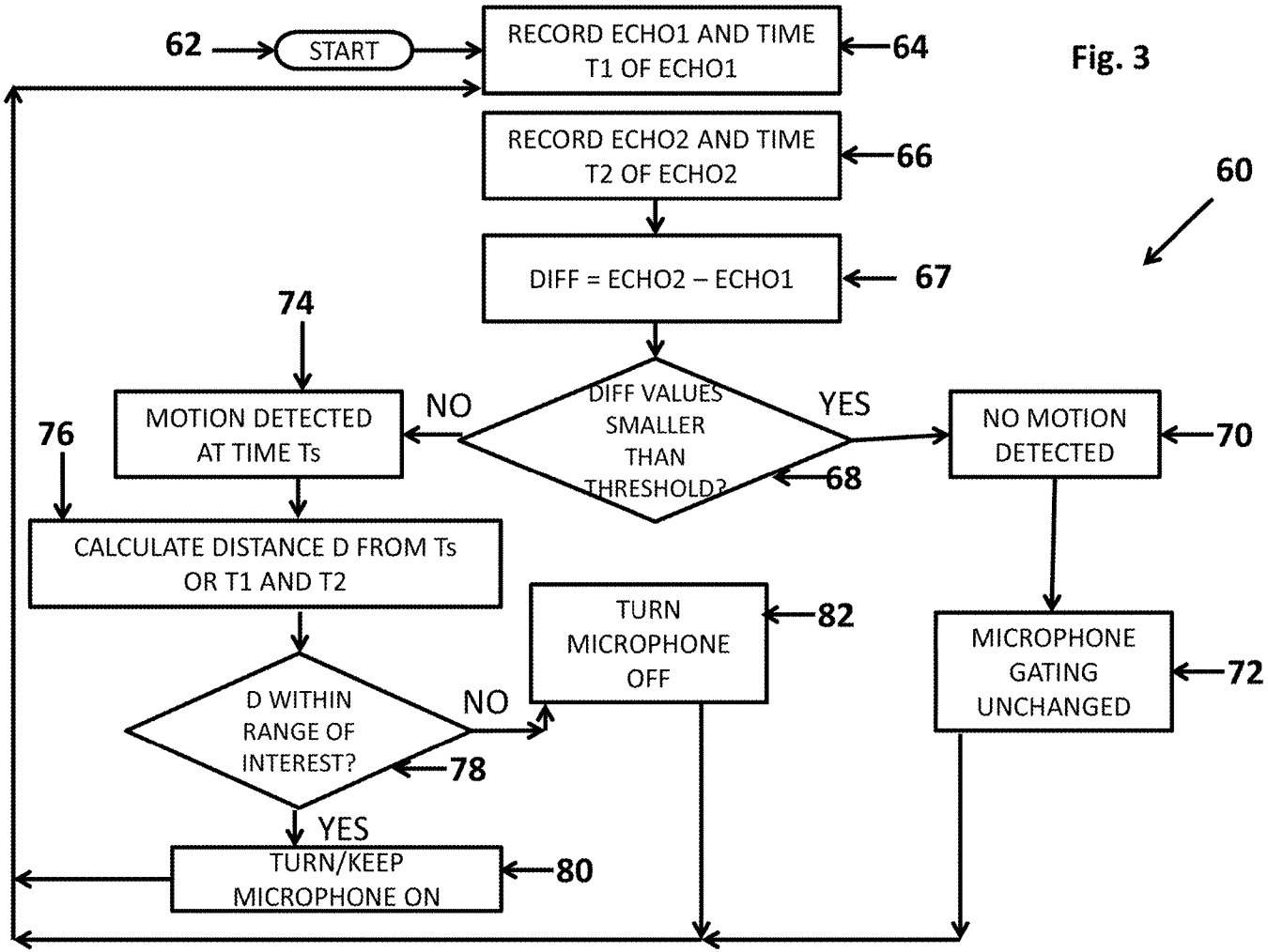
FIG. 3 is another illustrative flowchart outlining additional operations of the microphone gating system of FIG. 1, in accordance with at least some embodiments of the present disclosure.

Turning now to FIG. 3, an illustrative flowchart 60 outlining operations of performing microphone gating operations is shown, in accordance with at least some embodiments of the present disclosure. After starting at an operation 62, a first echo pulse, ECHO1 of the reflected signal 14 is recorded at an operation 64. The time, T1, taken by ECHO1 to travel from the transmitter 4 to the object 8 and back from the object to the receiver 6 is also recorded by the controller 10 at the operation 64. In at least some embodiments, the transmitter 4 and the receiver 6 may be positioned approximately equidistant from the object 8. The transmitter 4 and the receiver 6 may be considered approximately equidistant from the object 8 when, for example, both the transmitter and the receiver (the microphone 36 itself or a separate component) are mounted on, positioned adjacent to, or in the vicinity of the microphone. The transmitter 4 and the receiver 6 may also be considered approximately equidistant when, for example, the receiver (again, whether the microphone 36 is the receiver or the receiver is a separate component) is mounted on, positioned adjacent to, or in the vicinity of the microphone, and the transmitter 4 is positioned away from the microphone, but the distance between the transmitter and the object is substantially similar to the distance between the receiver and the object. In at least some other embodiments, the transmitter 4 and the receiver 6 may be non-equidistant from the object 8. In such cases, the recorded time, T1, may still include the time that ECHO1 may take for travelling from the transmitter 4 to the object 8 and then back from the object to the receiver 6.

Next, at an operation 66, a second echo pulse ECHO2 of the reflected signal 14 is recorded. The time, T2, taken by ECHO2 to travel from the transmitter 4 to the object 8 and from the object to the receiver 8 is recorded by the controller 10. Again, the transmitter 4 and the receiver 6 may be positioned approximately equidistant or non-equidistant from the object 8. It is noteworthy that ECHO2 need not always be the immediately following echo pulse after ECHO1. Rather, in at least some embodiments, ECHO2 may be a few (or many) echo pulses separated from ECHO1 for the same instance of the reflected signal 14 or possibly even be echo pulses of different instances of the reflected signal, as desired and pre-defined within the controller 10. Typically, the larger the time gap between ECHO1 and ECHO2, the slower the motion of the object 8 that may be detected.

After recording the ECHO1 and ECHO2 at operations 64 and 66, respectively, a difference between those echo pulses is computed at an operation 67. In at least some embodiments, ECHO1 may be subtracted from the more recent ECHO2 (e.g., ECHO2−ECHO1). Furthermore, in at least some embodiments, the difference may be computed by subtracting the buffers (described above) in which those echo pulses (e.g., ECHO1 and ECHO2) are stored, and the difference may take the form of a difference buffer, DIFF.

Additionally, the computed difference may be a difference between one or more properties of the echo pulses, such as amplitude, pulse length, etc. In other embodiments, a distance of the object 8 from the microphone 36, as described below, may be computed for both ECHO1 and ECHO2, and the difference in the distance values for ECHO1 and ECHO2 may be used to determine motion of the object 8. In yet other embodiments, several received echo pulses located close together in time (e.g., corresponding to several transmitted echo pulses located close together in time) may be averaged (e.g., by summing their respective buffers and dividing by the number of the buffers summed) for subtraction from another average taken at a different time (e.g., a period of time longer than that used for either average) to compute the difference buffer, DIFF, and to determine motion of the object 8, as discussed below. Alternatively, multiple difference buffers may be formed for the received echo pulses and subsequently averaged to get the difference buffer, DIFF at the operation 67. Other mechanisms to compute the difference between ECHO2 and ECHO1 may be used in other embodiments.

Next, at an operation 68, the values in the difference buffer, DIFF, are compared to a pre-defined threshold to determine if the object 8 has moved. Specifically, portions of the echo pulses in the difference buffer, DIFF, from the operation 67, whose magnitude exceeds a pre-defined threshold may represent movement of the object 8, while the position of those portions in the difference buffer, DIFF, may represent the distance of that object from the receiver 6. Thus, if the controller 10 determines at the operation 68 that the difference between ECHO2 and ECHO1 is small (or below the pre-defined threshold), then at an operation 70, the controller concludes that the object 8 has not moved from its previous position. In other words, the controller 10 concludes that the location of the object 8 is unchanged between the recording of ECHO2 and ECHO1. Without detecting any motion of the object 8, the controller 10 need not change the gating of the microphone 36. Thus, at an operation 72, the gating of the microphone 36 remains unchanged or, in other words, if the microphone was turned on before the current microphone gating operation, the controller 10 keeps the microphone turned on. Similarly, if the microphone 36 was turned off before the current microphone gating operation, the controller 10 keeps the microphone turned off. The process then goes back to the operation 64 to continue recording echo pulses for detecting motion of the object 8.

On the other hand, if at the operation 68, the computed difference between ECHO2 and ECHO1 is above the pre-defined threshold, then the controller 10, at an operation 74 determines that the object 8 has indeed moved from its previous location of where ECHO1 was recorded (again, note that ECHO2 is the more recent echo pulse). It is to be understood that other mechanisms, such as Doppler detection, motion detectors, and the like, may be used in other embodiments to detect motion of the object 8. Additionally and notwithstanding the fact that the controller 10 detects motion of the object 8, not all motion of the object results in a microphone gating operation. Rather, only relevant types of motion of the object 8 result in microphone gating operations. Motion of the object 8 is relevant if that motion is within the range of interest.

To determine if the motion of the object 8 is relevant, the controller 10 first calculates a current distance, D, of the object from the microphone 36 at an operation 76. Since, in at least some embodiments, the microphone 36 may be the receiver 6 or the receiver may be a separate component mounted to, or positioned adjacent or in the vicinity of the microphone, the distance, D, may be calculated between the receiver and the object 8. If the transmitter 4 and the receiver 6 are positioned approximately equidistant from the object 8, then the distance, D, is one half of a round trip distance that sound may travel from the transmitter/receiver to the object in time Ts. In some embodiments, time Ts is the time determined by measuring the difference between ECHO2 and ECHO1. Thus, the distance, D, is computed using the following equation:

$$D=(c*Ts)/2;\text{ where } c \text{ is the speed of sound.}$$

In those embodiments where the transmitter 4 and the receiver 6 are not approximately equidistant from the object 8, the distance is calculated using the time Ts measured from DIFF to travel between the receiver 6 and the object 8, using the following equation:

$$D=c*Ts,\text{ where } c \text{ is the speed of sound.}$$

Thus, for example, if the recording of ECHO1 and ECHO2 starts at the beginning of their respective echo pulse transmissions, for a sample-rate of about three hundred and twenty kilohertz (~320 kHz), if a portion of the difference between echo pulses in the difference buffer, DIFF, residing at a position of about hundred (~100) samples from the beginning of the difference buffer, DIFF, has a magnitude exceeding a threshold as determined at the operation 68, then estimated distance from transmitter 4 to the object 8 and back to the receiver 6 may be calculated as:

$$D=(100/320000*1116)=0.34\text{ feet}$$

where the speed of sound, c is 1116 feet/second and where the return time Ts=(100 samples)/(320000 samples/second)=0.312 milliseconds.

In other embodiments, depending upon the relative positioning of the transmitter 4 and the receiver 6, other mechanisms/values may be used to calculate the distance, D, from the object to the microphone 36. For example, two distance measurements may be carried out separately for ECHO2 and ECHO1 (using times T2 and T1 substituted for Ts in the above equations) and then by subtracting these distance measurements, motion may be estimated. Times, T1 and T2, may be calculated in a number of ways. For example, in at least some embodiments, the times, T1 and T2, may be identified by characteristics (e.g., portions of the reflected pulse or portions of an impulse response modelled using data from a collection or one or more buffers) of ECHO1 and ECHO2 that correspond to the object 8. In other embodiments, if a very short echo pulse is used, observing pulse or amplitude characteristics at specific times in the received echo (or its envelope) may provide an estimate of the presence of objects at those corresponding distances. Alternatively, if a longer random noise ultrasonic pulse or waveform is used, least-squares modelling may be performed based on correlation between the transmitted and received waveforms to estimate the impulse response running through the transmitter 4, the receiver 6, and the echo path. From these path models, acoustic reflections or amplitude characteristics (or changes) observed at locations corresponding to times, T1 and T2, may be used to provide an estimate of motion of the object 8. Other mechanisms may be used for calculating the distance, D, between the object 8 and the microphone 36 in other embodiments. When the motion of the object 8 is estimated using the times, T1 and T2, the operations 67 and 68 may be skipped. Also, if the motion detected at the operation 74 is determined from times, T1 and T2, then the operation 76 may assume the distance, D, corresponding to ECHO2 (as calculated from T2) for further processing, discussed below.

After computing the distance, D, at the operation 76, the controller 10 decides, at an operation 78, whether that distance is within the range of interest or not. By determining whether the distance is within the range of interest or not, the controller determines if the motion of the object 8 is relevant or not. As mentioned above, the range of interest may be a pre-defined range within the controller 10 and reflects a spatial range from the microphone 36 within which the microphone is desired to be turned on. The range of interest may include a lower bound closer to the microphone 36 and an upper bound further away from the microphone. Thus, in at least some embodiments, the range of interest may be a range from a lower bound of a few inches from the microphone 36 to an upper bound of a few feet away from the microphone. For example, in some embodiments, the range of interest may be from about six inches to about two feet (~6"-2"). In other embodiments, the range of interest may vary. Thus, if at the operation 78, the controller 10 determines that the distance, D, is within the range of interest, then at an operation 80, the controller turns the microphone 36 on (if the microphone was off before) or keeps the microphone on (if the microphone was already on).

In addition to using the range of interest to perform microphone gating operations, in at least some embodiments, the controller 10 may use a counter to prevent the microphone 36 from sporadically switching on and off multiple times in a short period of time. Thus, the controller 10 may use a counter, CNT, that may count up to a limit when the controller detects motion of the object 8 and may count down to zero if the controller does not detect motion of the object. In at least some embodiments, the motion that changes the value of the counter (whether counting up or down) may include motion of the object 8 within the range of interest. Specifically, when the controller 10 detects any motion of the object 8 within the range of interest, the counter, CNT, is incremented by a pre-defined value, such as, Xup. Similarly, when the controller 10 does not detect motion of the object 8 within the range of interest, the counter, CNT, is decremented by another pre-defined value, Xdn.

Thus, CNT=CNT+Xup, if motion of the object 8 is detected within the range of interest; and CNT=CNT−Xdn, if motion of the object 8 is not detected within the range of interest.

Furthermore, the range of the counter, CNT, is typically pre-defined between zero and CNTmax. By defining a "turn on" threshold CNT2 to be greater than a "turn off" threshold CNT1, the controller 10 controls the microphone gating operations based not only on the current condition of motion detection (e.g., motion detected or not detected) but also on the past conditions of motion detection. Thus, for example, if the microphone 36 is currently turned on and CNT is less than CNT1, then the microphone is turned off. However, if the microphone 36 is currently turned on and CNT is greater than CNT1, then the microphone remains turned on. Similarly, if the microphone 36 is currently turned off and CNT is greater than CNT2, then the microphone is turned on. However, if the microphone 36 is currently turned off and CNT is less than CNT2, then the microphone remains turned off. Thus, by making CNT2>CNT1, the controller 10 achieves a hysteresis threshold to reduce sporadic on/off transitions of the microphone 36 as the object 8 enters and leaves the range of interest. Therefore, the controller 10 performs microphone gating operations not only based upon motion of the object 8 within the range of interest, but also based on the position of the counter relative to the "turn on" and "turn off" thresholds. In at least some embodiments, CNTmax=60, Xup=5, Xdn=2, CNT1=2 and CNT2=10. In other embodiments, the values of the parameters above may be different.

Additionally, in at least some embodiments, the controller 10 may use a fading operation in conjunction with the range of interest and the counter mechanism described above to control the microphone gating operations. In a fading operation, after determining whether the object 8 is within the range or interest or not at the operation 78, the controller 10 determines the specific location of the object relative to the lower and the upper bounds of the range of interest. For example, the controller 10 determines whether the object 8 is situated closer to the upper bound of the range of interest, whether the object is situated closer to the lower bound of the range of interest, or somewhere in between. By virtue of determining the position of the object 8 within the range of interest, the controller 10 begins to fade out the microphone 36 gradually (e.g., gradually reduce the amplification of the microphone) if the object 8 is found to move away from the microphone (e.g., from the lower bound towards the upper bound) but remains within the range of interest. Likewise, the controller 10 begins to gradually ramp up the amplification of the microphone 36 as the object moves closer to the microphone (e.g., from the upper bound towards the lower bound) within the range of interest.

Furthermore, in some embodiments, the controller 10 smoothly fades the gain of the microphone 36 as a function of time once the object 8 has entered or left the range of interest. In at least some embodiments, the controller 10 fades the signal of the microphone 36 in dependence on both the distance of the object 8 and time. For example, in at least some embodiments, once the object 8 has entered the range of interest, the controller 10 ramps (or fades) the gain from off to on over a time period of about ten milliseconds (~10 ms). As the object 8 leaves the range of interest, the controller 10 ramps the gain back down to the gated off level over a different time interval of about four hundred milliseconds (~400 ms). In other embodiments, the fade time intervals may vary from those described above.

Additionally, in some embodiments, the controller 10 also sets the gain in relation to or as a function of the value of the counter, CNT. In these cases, the controller 10 starts to increase the gain as the value of CNT increases beyond CNT1 as a function of the difference CNT-CNT1, where once the value of CNT reaches CNT2, the microphone 36 may be fully gated on. As CNT progresses above CNT2, the gain may remain limited to the gated on level. In a similar manner, the controller 10 reduces the gain as the value of CNT is reduced from CNT2 to CNT1, reaching the gain for the gated off level when CNT=CNT1 and remains off when CNT progresses to values less than CNT1. Other functions for determining the gain utilizing the value of CNT, time, distance D, range of interest or a combination of them for fading the gain may be used in other embodiments.

Thus, at the operation 78, if the controller 10 determines that the motion of the object 8 is within the range of interest, the controller turns on (or keeps on) the microphone 36 at the operation 80. Again, the controller 10 may be configured to use a counter mechanism to prevent sporadic switching of the microphone 36, as well as use a fading operation to gradually alter the amplification of the microphone.

On the other hand, if at the operation 78, the controller 10 determines that the distance, D, is outside the range of interest, the controller turns the microphone 36 off at an operation 82 if the microphone was previously turned on, or keeps the microphone turned off, if the microphone was already off. As discussed above, the controller 10 turns on or turns off the microphone 36 by controlling the microphone gate switch 38, which in turn controls the microphone connector 42 to turn the microphone on or off. After turning (or keeping) on the microphone 36 at the operation 80 or turning (or keeping) off the microphone at the operation 82, the process goes back to the operation 64 to continue recording echo pulses for continuously detecting motion of the object 8 and for controlling the gating of the microphone in response to the detected motion.

Figure 4:
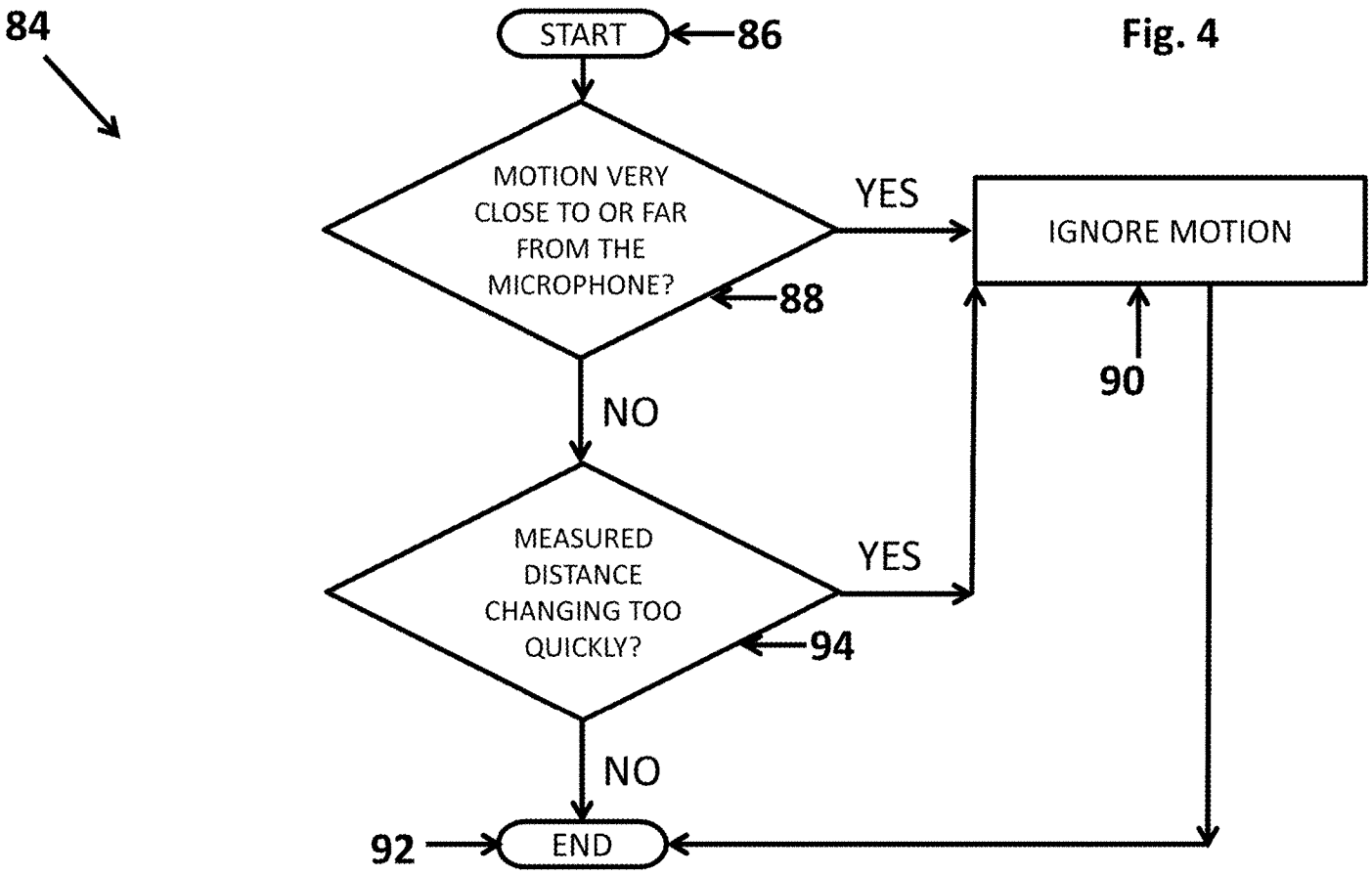
FIG. 4 is yet another illustrative flowchart outlining operations of the microphone gating system of FIG. 1, in accordance with at least some embodiments of the present disclosure.

Turning now to FIG. 4, another illustrative flowchart 84 outlining motion within the range of interest that the controller 10 may ignore is shown, in accordance with at least some embodiments of the present disclosure. As discussed above, the controller 10 records echo pulses (e.g., ECHO1 and ECHO2) of the reflected signal 14 and determines from a difference of those echo pulses (e.g., from the difference buffer, DIFF) whether the object 8 has moved from a previous location. However, motion apart from the motion of the object 8 within the range of interest may trigger the controller 10 to detect motion. For example, when ultrasonic or ultrasound signals are employed for the transmit signal 12 and the reflected signal 14, motion of musical instruments and other devices that generate noise at ultrasonic frequencies may trigger the controller 10 to erroneously detect motion. Such erroneously detected motion, also termed as "ultrasonic noise," may result in the microphone 36 being erroneously turned on or off. Therefore, the controller 10 is configured to sense such "ultrasonic noise" and ignore any detected motion attributable to the "ultrasonic noise."

Thus, after detecting motion at an operation 86, the controller 10 determines whether the motion is "ultrasonic noise" and if so, ignores that motion. The inventors have found that, among commonly used musical instruments, cymbals often generate a significant "ultrasonic noise" and are frequently the source of erroneous motion detection by the controller 10. The inventors have further found that cymbals cause erroneous motion detection at substantially all distances from the microphone 36, regardless of whether the distance is within or outside the range of interest. To reliably filter out the "ultrasonic noise" attributable to a cymbal (and possibly other devices generating sound at ultrasonic frequencies), the controller 10 is configured to ignore motion that is detected either too close or too far from the microphone 36 or when the location of the motion varies substantially within a short period of time.

Specifically, at operation 88, if the controller 10 determines that the detected motion is "too close" to or "too far" from the microphone 36, then the controller ignores the detected motion at an operation 90 and keeps the microphone gating unchanged. The range of motion that is considered "too close" to or "too far" from the microphone 36 is pre-defined in the controller 10. In at least some embodiments, motion is "too close" if the motion is detected within about one to two inches of the microphone 36 and "too far" if the motion is detected at more than a few feet from the microphone. In other embodiments, the "too close" or "too far" ranges may be different. Additionally, in at least some embodiments, the range of interest may be defined such that the lower and upper bounds of the range of interest may exclude the "too close" and "too far" ranges. Thus, for example, if the "too close" range is about one to two inches, then in at least some embodiments, the lower bound of the range of interest may be made to start from about three inches. Similarly, if the "too far" range is about two to three feet from the microphone 36, then the upper bound may be made to stop a little before the "too far" range. The above mentioned "too close" and "too far" ranges may vary in other embodiments.

Therefore, if the controller 10 determines that the detected motion is "too close" to the microphone 36 (where in normal use, moving objects such as singers or talkers may be assumed to nominally operate at least a few inches to a few feet from the microphone), then at the operation 90, the controller assumes that the detected motion is attributable to "ultrasonic noise" and ignores that motion. In at least some embodiments, the transmitter 4 may be highly resonant or subject to a narrow band of operation near the desired frequency of the echo pulses. In these cases, transient decay artifacts may linger or continue to be broadcast for a brief time after the transmit signal 12 has been turned off. "Ultrasonic noise" may result when the receiver 6 detects these transient artifacts from the transmitter 4 immediately after it has been turned off at the termination of an echo pulse. This may happen if too little time is allowed between the ending of a transmit signal 12 and the time when detection of the reflected signal 14 is to begin. Furthermore, and as noted above, noise sources such as cymbals may cause motion to be detected at all distances, including motion closer to or farther than the range of interest. The process ends at an operation 92 with the controller 10 continuing to monitor the motion of the object 8, as described in FIG. 3 above.

In addition to ignoring motion that may be "too close" to or "too far" from the microphone 36, the controller 10, at an operation 94, is also configured to ignore detected motion if that motion indicates a substantial variance or difference in location between one set of echo pulses to the next. For example, if the controller 10 detects a first motion that is within the range of interest but closer to the microphone 36 and a second motion a second later that is also within the range of interest, but substantially farther away from the first motion, the controller is configured to attribute the second motion as "ultrasonic noise" and ignore the second motion. Thus, if it is practically impossible for the object 8 to move from one location to another in a given amount of time, the controller 10 is configured to ignore the second (e.g., the most recent) motion at the operation 90.

It is to be understood that although FIG. 4 describes two mechanisms for determining "ultrasonic noise," other mechanisms for ignoring motion attributable to "ultrasonic noise" or background noise may be employed, as desired, in other embodiments.

Additionally, notwithstanding the embodiments described above in FIG. 1-4, various modifications and inclusions to those embodiments are contemplated and considered within the scope of the present disclosure. For example, in at least some embodiments, one or more microphones in addition to the microphone 36, positioned adjacent to each other, may be used in the microphone gating system 2. In at least some embodiments, the multiple microphones may be installed on the same microphone stand such that when the microphone stand is moved, all microphones are simultaneously moved. In other embodiments, the multiple microphones may be mounted on different microphone stands (or locations), such that each microphone stand (and therefore the microphone mounted to that stand) may be moved independent of the other microphone stands. Furthermore, when using multiple microphones, whether all on the same or different microphone stands, each of the multiple microphones may have its own transmitter and receiver. Furthermore, each of the multiple microphones may be chosen such that their transmitters and receivers have a certain directionality (also called directivity) such that "cross talk" between the multiple microphones may be reduced.

Directivity may be defined as a microphone's sensitivity to sound and noise from various directions. For example, some microphones are omnidirectional in that they pick up sound evenly from all directions. Other microphones are unidirectional in that they pick up sound from only one direction, or microphones are bidirectional in that they pick up sounds evenly from two opposite directions. Furthermore, the transmitter 4 and the receiver 6 of a microphone may have the same or different directivity. Also, the directivity of the microphones within a multiple microphone configuration may vary.

When multiple microphones are used, depending upon the directivity of those microphones (e.g., directivity of their respective transmitters and receivers), signals (or pulses) from the transmitters and receivers of those microphones may interfere with each other leading to false motion detection. False motion detection when using multiple microphones may happen, for example, when a microphone A may pick up the transmit signal 12 of a microphone B and vice-versa. This may also happen when microphone A may pick up the reflected signal 14 of the microphone B and vice-versa. Regardless of whether the microphone A and the microphone B are mounted to the same microphone stand or to separate microphone stands, if the clocks of microphone A and microphone B are not synchronized, each microphone may consider the intercepted signal (whether the transmit signal 12 or the reflected signal 14) from the other microphone as motion. Even if the clocks of microphone A and microphone B are synchronized but the microphones are mounted to different microphone stands, if one microphone (e.g., microphone A) physically moves relative to the other microphone (e.g., microphone B), the microphones may deem the signals intercepted from one another as motion. If the microphone A and the microphone B are mounted to the same microphone stand and the clocks of those microphones are synchronized, movement of the microphone stand may, in most cases, not result in a false motion detection since both the microphone A and the microphone B move together with the microphone stand.

To improve false motion detection attributable to multiple microphones positioned adjacent to one another, in at least some embodiments, the directivity of the microphones (and therefore the directivity of the transmitters and receivers of the microphones) is adjusted to reduce "cross-talk" between those microphones. For example, in at least some embodiments, the directivity of the multiple microphones is increased or, in other words, the microphones are made unidirectional (whether cardioid or hyper-cardioid) or bi-directional. In a unidirectional cardioid microphone directivity, the microphone transmits signals to and picks signals up from mostly the front of the microphone and to a lesser extent from the side of the microphone. In a unidirectional hyper-cardioid microphone directivity, also known as a shot gun microphone, the microphone transmits signals to and picks signals from substantially the front of the microphone only. In contrast, in a bi-directional microphone directivity, the microphone evenly transmits signals to and picks signals from two opposite directions.

While increasing the directivity of the microphones may reduce "cross talk" between those microphones, it may nonetheless impact the microphone gating operations. For example, for microphones with increased directivity, the object 8 may need to be substantially in front of the microphones to detect motion of the object and to turn on or turn off the microphone 36. Further, it is to be understood that the multiple microphones in a multiple microphone configuration may each have different directivities. The directivity of each of the multiple microphones may be adjusted based upon an acceptable trade-off between "cross-talk" amongst those multiple microphones and the desired spatial range of motion detection to trigger microphone gating operations.

In some embodiments, each microphone may each use a transmitter 4 and receiver 6 that are tuned to transmit and receive at a unique ultrasonic frequency (different from other microphones) to further avoid cross-talk between them.

Furthermore, in at least some embodiments, a transducer (not shown) may be used in the microphone gating system 2. The transducer may be used both as the transmitter 4 to emit the transmit signal 12 and the receiver 6 to receive the reflected signal 14. The transducer may be mounted to, or located adjacent to, or in the vicinity of the microphone 36. Using a single transducer for both the receiver 6 and the transmitter 4 may, advantageously, save space and cost of the microphone gating system 2 and benefit from the directivity of the transducer, essentially doubling the directivity, since the transmitter and the receiver in a transducer both have the same directivity. On the downside, transducers may be more susceptible to background noise and specifically "ultrasonic noise" such as that resulting from the operation of cymbals.

Additionally, like the multiple microphone configuration, multiple transducers may be used in lieu of multiple microphones, in other embodiments. In some other embodiments, a combination of microphones and transducers may be used as well. Furthermore, in at least some embodiments, an accelerometer may be fitted onto or within the microphones or the transducers. The accelerometer may be used to detect motion of the microphone(s) and the transducer(s) themselves and convey the motion information to the controller 10. The controller 10 may then factor in the motion of the microphone(s) and the transducer(s) in determining the motion of the object 8 or in determining if the microphone 36 is being held by a person.

Also, as briefly noted above, in at least some embodiments, one or more edge enhancement filters may be employed for improving the quality of one or both of the transmit signal 12 and the reflected signal 14. In other embodiments, other mechanisms for enhancing the quality of those signals and distinguishing those signals from background noise may be employed. Again, other devices, components and systems that are commonly used with microphones are contemplated and considered within the scope of the present disclosure.

Any of the operations described herein can be implemented as computer-readable instructions stored on a non-transitory computer-readable medium such as a computer memory.

It is also to be understood that the construction and arrangement of the elements of the systems and methods as shown in the representative embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed.

Accordingly, all such modifications are intended to be included within the scope of the present disclosure. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other illustrative embodiments without departing from scope of the present disclosure or from the scope of the appended claims.

Furthermore, functions and procedures described above may be performed by specialized equipment designed to perform the particular functions and procedures. The functions may also be performed by general-use equipment that executes commands related to the functions and procedures, or each function and procedure may be performed by a different piece of equipment with one piece of equipment serving as control or with a separate control device.

Moreover, although the figures show a specific order of method operations, the order of the operations may differ from what is depicted. Also, two or more operations may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection operations, processing operations, comparison operations, and decision operations.

What is claimed is:

1. A method, comprising:

emitting, using a transmitter, a first set of signals towards an object;

detecting, using a receiver, a second set of signals corresponding to the first set of signals, wherein changes in position of the object cause corresponding changes in the detected second set of signals;

determining, by a controller, a distance of the object from the receiver based on the second set of signals detected using the receiver;

determining, by the controller, that the distance of the object from the receiver is within a predetermined range; and performing, by the controller, a microphone gating operation in response to the determination that the distance of the object from the receiver is within the predetermined range.

2. The method of claim 1, further comprising detecting that the object has changed position relative to the receiver based on the second set of signals detected by the receiver, wherein the microphone gating operation is performed only if a change in position of the object relative to the receiver is detected.

3. The method of claim 1, wherein the second set of signals includes one or more transmit signals reflected from the object.

4. The method of claim 3, wherein detecting the second set of signals comprises:

recording a first echo of the second set of signals by the controller, the first echo corresponding to a first position of the object; and recording a second echo of the second set of signals by the controller, the second echo corresponding to a second position of the object.

5. The method of claim 4, further comprising:

determining, by the controller, a time Ts, taken by measuring a difference between the second echo and the first echo of the second set of signals;

detecting a change in position of the object if Ts is greater than a pre-defined threshold; and detecting no change in position of the object if Ts is below the pre-defined threshold.

6. The method of claim 1, wherein performing the microphone gating operation comprises turning the microphone on, by the controller, when the distance is within the predetermined range.

7. The method of claim 1, wherein performing the microphone gating operation comprises turning the microphone off, by the controller, when the distance is outside the predetermined range.

8. The method of claim 1, wherein performing the microphone gating operation comprises changing a gain of the microphone, by the controller, when the distance is within or outside the predetermined range.

9. The method of claim 1, further comprising gradually ramping up amplification of the microphone, by the controller, as the object moves closer to the receiver.

10. The method of claim 1, further comprising gradually ramping down amplification of the microphone, by the controller, as the object moves away from the receiver.

11. The method of claim 1, wherein the predetermined range is a range selected from the group consisting of:

a predetermined distance from the receiver or farther;

between a first distance from the receiver and a second distance from the receiver; and a predetermined distance from the receiver or closer.

12. The method of claim 1, wherein the object is a source of audible sound detectable by the microphone.

13. The method of claim 1, wherein the first and second sets of signals are ultrasonic, and wherein the receiver is also the microphone.

14. A system, comprising:

a transmitter configured to emit signals towards an object;

a receiver configured to detect signals corresponding to the signals emitted by the transmitter, wherein changes in position of the object cause corresponding changes in the detected signals; and a controller configured to:

instruct the transmitter to emit a first set of signals towards an object, and receive a second set of signals detected by the receiver;

determine a distance of the object from the receiver based on the second set of signals detected by the receiver;

determine that the distance of the object from the receiver is within a predetermined range; and perform a microphone gating operation in response to the determination that the distance of the object from the receiver is within the predetermined range.

15. The system of claim 14, wherein the second set of signals includes one or more transmit signals reflected from the object.

16. The system of claim 14, wherein performing the microphone gating operation comprises turning the microphone on when the distance is within the predetermined range.

17. The system of claim 14, wherein performing the microphone gating operation comprises turning the microphone off when the distance is outside the predetermined range.

18. The system of claim 14, wherein performing the microphone gating operation comprises changing a gain of the microphone when the distance is within or outside the predetermined range.

19. The system of claim 14, wherein the controller is further configured to gradually ramp up amplification of the microphone as the object moves closer to the receiver.

20. The system of claim 14, wherein the controller is further configured to gradually ramp down amplification of the microphone as the object moves away from the receiver.

21. The system of claim 14, wherein the receiver is also the microphone.

22. A system, comprising:

a transmitter configured to emit ultrasonic transmit signals towards an object;

a receiver configured to detect transmit signals reflected from the object; and a controller configured to:

instruct the transmitter to emit a set of transmit signals towards the object, and receive a set of reflected signals detected by the receiver;

determine a distance from the receiver to the object based on the set of reflected signals;

determine that the distance of the object from the receiver is above or below a distance threshold; and perform a microphone gating operation of a microphone in response to the determination that the distance of the object from the receiver is above or below the distance threshold.

23. The system of claim 22, wherein the controller is configured to turn the microphone on if the distance is within a range of interest, and turn the microphone off if the distance is not within the range of interest.

24. The system of claim 22, wherein the receiver is also the microphone.

* * * * *